US005527149A

United States Patent [19]

Moss et al.

[11] Patent Number: 5,527,149

[45] Date of Patent: Jun. 18, 1996

[54] EXTENDED RANGE REGENERATIVE PUMP WITH MODIFIED IMPELLER AND/OR HOUSING

[75] Inventors: Norman Moss, St. Clair Shores; Robert S. Czarnowski, Oxford, both of Mich.

[73] Assignee: Coltec Industries Inc., New York, N.Y.

[21] Appl. No.: 253,543

[22] Filed: Jun. 3, 1994

[51] Int. Cl.[6] ..... F04D 5/00; F04D 29/40

[52] U.S. Cl. ..... 415/55.1; 415/912

[58] Field of Search ..... 415/55.1, 55.2, 415/55.4, 912

[56] References Cited

U.S. PATENT DOCUMENTS

| | | | |
|---|---|---|---|
| 3,849,024 | 11/1974 | Masai et al. . | |
| 3,915,589 | 10/1975 | Vander Linden . | |
| 4,204,815 | 5/1980 | LeBlanc . | |
| 4,325,672 | 4/1982 | Sixsmith et al. | 415/55.1 |
| 4,386,886 | 6/1983 | Neal | 415/912 |
| 4,838,772 | 6/1989 | LeBlanc . | |
| 5,143,511 | 9/1992 | Verneau et al. | 415/55.4 |
| 5,163,810 | 11/1992 | Smith . | |
| 5,205,707 | 4/1993 | Smith et al. | 415/55.1 |
| 5,299,908 | 4/1994 | Robbie | 415/55.1 X |
| 5,302,081 | 4/1994 | Smith | 415/55.1 |
| 5,328,325 | 7/1994 | Strohl et al. | 415/55.1 |
| 5,407,318 | 4/1995 | Ito et al. | 415/55.1 X |

FOREIGN PATENT DOCUMENTS

| | | | |
|---|---|---|---|
| 2244933 | 3/1974 | Germany | 415/55.2 |
| 57-62996 | 4/1982 | Japan | 415/55.1 X |
| 57-81191 | 5/1982 | Japan | 415/55.1 X |
| 57-86596 | 5/1982 | Japan | 415/55.1 X |
| 57-97097 | 6/1982 | Japan | 415/55.1 X |

OTHER PUBLICATIONS

Inaba et al., A Study on a Vortex Blower—1st Report, Effect of the Shape of Impeller and Modifications of the Inlet of Blower, pp. 973–979, Jul. 13, 1979.

Inaba et al., A Study on a Voltex Blower—2nd Report, Effect of the Blade Angles and a Theoretical Analysis of the Performance, pp. 157–163, Nov. 8, 1979.

Wilson et al., A Theory of the Fluid–Dynamic Mechanism of Regenerative Pumps, pp. 1303–1316, Nov., 1955.

Sasahara et al., Researches on the Performance of the Regenerative Type Fluid Machinery—1st Report, Inner Flow and Performance Coeficients, pp. 2047–2054, Feb. 9, 1979.

(List continued on next page.)

*Primary Examiner*—Edward K. Look
*Assistant Examiner*—Michael S. Lee
*Attorney, Agent, or Firm*—Howard S. Reiter

[57] ABSTRACT

A regenerative or toric pump adds energy to a fluid using an impeller having an axis of rotation and axially spaced, radially extending first and second surfaces. A casing encloses the impeller and has a fluid inlet and a fluid outlet separated by a stripper. The casing has axially spaced, radially extending first and second sidewalls facing the first and second surfaces of the impeller respectively. Axially and radially extending blades or vanes are formed on an outer radial periphery of the impeller for driving fluid from the inlet toward the outlet as the impeller rotates about the axis of rotation. A fixed surface is formed in at least one sidewall of the casing for directing fluid back toward the impeller. Improved operating characteristics and extended range are accomplished through modification to the vane configuration of the impeller and/or by modification of the side channel configuration of the pump chamber in an asymmetrical fashion. The vanes can be modified to include a radially inward base portion extending in a generally trailing direction with respect to rotation of the impeller and a radially outward tip portion extending in a generally leading direction. The blades may also include a chamfered surface on the trailing edge of the base portion. The impeller chamber can be modified separately by expanding a side channel in the casing, or by insertion of a spacer between the side channel and the remaining portion of the casing defining the impeller chamber.

36 Claims, 9 Drawing Sheets

OTHER PUBLICATIONS

Sixsmith et al., A Regenerative Compressor, pp. 637–647, Aug. 4, 1976.

Power Magazine, Reducing Industrial Cost, pp. 218–219, Aug., 1984.

Von Katrayulu et al., Influence of Freely Rotating Inlet Guide Vanes on the Return Flows and Stable Operating Range of an Axial Flow Fan, pp. 75–79, Jan. 1980.

EXTENDED RANGE REGENERATIVE PUMP WITH MODIFIED IMPELLER AND/OR HOUSING

FIELD OF THE INVENTION

The present invention is directed to a regenerative pump, sometimes referred to as a toric pump, especially designed for economical mass production which is capable of developing higher pressures and flow rates at higher efficiencies than other pumps of comparable design and operating speed, by modifications made to the impeller and/or housing.

BACKGROUND OF THE INVENTION

In an automotive emission control system, a pump supplies air as required to the exhaust system between the manifold and the catalytic converter. In conventional regenerative pumps intended for use in an automotive emission control system, the impeller has straight radially extending blades at its outer periphery and is driven in rotation between a pump housing and a cover formed with a pump chamber. The pump chamber is formed symmetrical with respect to the rotatable impeller, and the surfaces of the housing and the cover. Further descriptions of toric pumps of this construction can be obtained from U.S. Pat. Nos. 5,302,081; 5,205,707 and 5,163,810.

Over time, industry needs have changed as restrictions on emissions have changed. It is now desirable to provide more air to an automotive emission control system than was previously required. Currently, it is desirable to provide at least between 19 and 20 cubic feet per minute (cfm). It is also desirable to meet the minimum fluid flow requirements while maintaining the same size housing. To meet these new fluid flow requirements, it has been necessary to double, and in some instances quadruple, the currently existing fluid flow rates of regenerative single stage pumps. Up to this point in time, the typical regenerative pump used in automotive emission control system applications has been capable of achieving a fluid flow rate of only 4 cubic feet per minute (cfm) at approximately 40 inches ($H_2O$) head, and therefore, it is desirable in the present invention to provide a greater fluid flow output at the same or greater pressure for a given size housing configuration. It is further desirable in the present invention to reduce the electrical current or power requirements for a motor used in an electric motor driven pump for a given pressure and/or flow output. It is also desirable in the present invention to reduce the rotational speed of the motor required for a given pressure and/or flow rate output. Additionally, it is desirable in the present invention to increase overall efficiency and to provide for longer life and enhance reliability of regenerative pumps, and in particular, single stage, double channel, electrical air pumps or compressors.

SUMMARY OF THE INVENTION

In a regenerative pump according to the present invention, the rotor vanes of the peripheral regenerative pump are arcuate when viewed from the side, with the upper and lower portions curved forward in the direction of rotation. Preferably, a chamfer, or similar relief is formed on the convex side of the inner portion of all vanes. Bending the root portion of the vane to face forward and the addition of the chamfer are aimed at reducing pressure energy losses in the fluid entry region. Energy losses in the fluid entry region are the dominant loss in this type of regenerative pump. Prototypes of an impeller according to the present invention have been produced and tested. The test results have indicated a pressure increase, for the same rotational speed, of no less than 60% over the whole operating range and no less than 100% over a substantial portion of the whole operating range. In the tests, flow also increases over the operating range. Such dramatic increases in pressure and flow were unexpected.

The present invention also concerns double channel regenerative pumps of the type embodying a central rotor with vanes extending generally radially, either in a straight radial fashion, or in an arcuate fashion. Previously, it has been difficult to achieve a proper matching of the output of such a regenerative pump or compressor to the requirements of a particular application. Although some matching could be achieved by judicial choice of shaft rotational speed, pump efficiency can suffer in the process. Typically, a pump of this type includes a housing means for mounting a drive motor and one of the side channels, a rotor with generally radially extending vanes at its outer region on one or more axial sides of the rotor, and a cover sealingly engaged with the housing and a second side channel. The present invention allows matching of a pump's capacity to the requirements of a particular application without changing shaft rotational speed. Previously the channels and the housing and cover have been equal, or symmetrical in cross-section, and differ only at the channel ends where it is common to place transfer inlet and delivery passages from the housing channel to ducts in the cover or housing. In the present invention, the channels of the housing and cover are formed in a manner which is not symmetrical. The cover, which is freely accessible, can be replaced by alternative covers having channels of various depths, or the cover can be spaced axially outwardly from the impeller by insertable spacers of various depths to change the effective depth of the channel in the cover. Thereby, the specific output of the pump may be varied to suit different fluid flow requirements by providing the appropriate asymmetrical depth of channel. Prototypes of asymmetrical side channels have been constructed and tested. These tests show that a change in capacity of at least 20% can be achieved by varying the axial depth of the channel without loss in the overall efficiency of the regenerative pump. The prototype of the present invention that was tested included a spacer plate inserted between the housing and the cover. The plate increased one of the side channels by a depth according to the thickness of the plate. Thus, a deeper channel can be provided without requiring the costly and time consuming measure of manufacturing a new cover. The magnitude of enhancement to pump performance was unexpected.

A regenerative pump for adding energy to a fluid, according to the present invention, includes an impeller having an axis of rotation and axially spaced, radially extending first and second surfaces. A radially split casing encloses the impeller and has a fluid inlet and a fluid outlet separated by a stripper. The stripper generally has a close clearance to a periphery of the impeller. The casing has axially spaced, radially extending first and second side walls facing the first and second surfaces respectively. Axially and radially extending blade means is formed on an outer radial periphery of the pump for driving fluid from the inlet toward the outlet as the impeller rotates about the axis of rotation. Means, formed in at least one side wall of the casing, directs fluid back toward the impeller.

The blade means preferably includes a plurality of vanes spaced circumferentially around the outer radial periphery of the impeller. Each vane has a radially inward base portion extending in a generally trailing direction with respect to rotation of the impeller and a radially outward tip portion extending in a generally leading direction with respect to rotation of the impeller.

Chamfer means is preferably formed on the base portion of each vane for deflecting fluid from the inlet toward the pocket defined between two adjacent vanes and the casing. Preferably, the chamfer means is formed on a trailing edge of the base portion of each vane. The chamfer means may be formed at an angle with respect to a radially extending plane normal to the axis of rotation of the impeller at a range selected from between 10° and 45° inclusive. Alternatively, the chamfer means may be formed as a curved surface having a predetermined radius connecting a generally radially extending surface of each vane to a generally axially extending surface of the respective vane along a trailing edge.

The blade means may include a plurality of vanes spaced circumferentially around the outer radial periphery of the impeller, where each vane is bent in radial direction with respect to the axis of rotation of the impeller about an axis generally parallel with the axis of rotation of the impeller. Alternatively, the blade means may include at least one set of radially bent vanes with respect to the axis of rotation, where the set of vanes is defined by at least two circumferentially spaced vanes collaborating with one another to form a single circular annulus.

The base portion of each vane preferably forms an entry angle with respect to a radially extending plane normal to the axis of rotation of the impeller in a range selected from between 20° and 30° inclusive. The tip portion preferably forms an exit angle with respect to a radially extending plane normal to the axis of rotation of the impeller in a range selected from between 20° and 45° inclusive.

The impeller has a generally radially extending plane or web normal to the axis of rotation and connected to the blade means. The web extends radially into the blade means to a position generally midway between the base and the tip of each vane. Preferably, the right angle surfaces, formed by the web and an annular hub of the impeller supporting the base of each vane, is filled in to provide an angled, stepped, or preferably radially curved transition between the axially extending hub portion of the impeller and the radially extending web between each adjacent set of vanes.

The fluid directing means preferably includes a fixed shaped surface. The fluid directing means may include at least one of the first and second side walls having a generally ring-shaped, side channel portion formed in the casing around the axis of rotation for directing fluid helically back into contact with the blade means as the impeller rotates. Preferably, the side channel portion is generally perpendicular to and along an arc of constant radius centered on the axis of rotation. In the preferred embodiment, the fluid directing means includes each of the first and second side walls having a generally ring-shaped side channel portion formed therein around the axis of rotation of the impeller for directing fluid helically back into contact with the blade means as the impeller rotates. Preferably, the fluid directing side channel portion of one of the first and second side walls is enlarged with respect to the other fluid directing side channel portion. Preferably, the enlarged one of the side channel portions is enlarged in the axial direction. The fluid directing means preferably is formed asymmetrically in the first and second side walls of the casing around the axis of rotation of the impeller.

Regenerative pumps have traditionally been constructed, when there are two channels, with side channels equal in cross-section. The present invention demonstrates that unequal channels cause no significant loss in efficiency or other deleterious effects. The option of using unequal channels facilitates convenient capacity modifications so that a single pump design may have its pumping characteristics modified to satisfactorily meet more than one specific application requirement. The asymmetric channels according to the present invention may be used with a standard configuration impeller for a regenerative pump, or may be used in combination with the arcuate vane impeller configuration according to the present invention for further performance enhancement. The rear swept lower, or entry, or base portion of the vane with forward swept tip approximately midway up from the root of the vane, as previously described with respect to the present invention, can advantageously be used in combination with the asymmetric channels. The arcuate vane configuration, as previously described, can also include the modification of chamfer means for easing entry of fluid, particularly where the entry angle is large relative to the impeller axis. As the flow rate is reduced and the pressure rises, the ease of entry for fluid into the impeller is a feature that is associated with results that reveal improved maximum pressure for a given shaft speed and higher efficiency. As previously described, the chamfer means may also take an alternative curvilinear profile.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
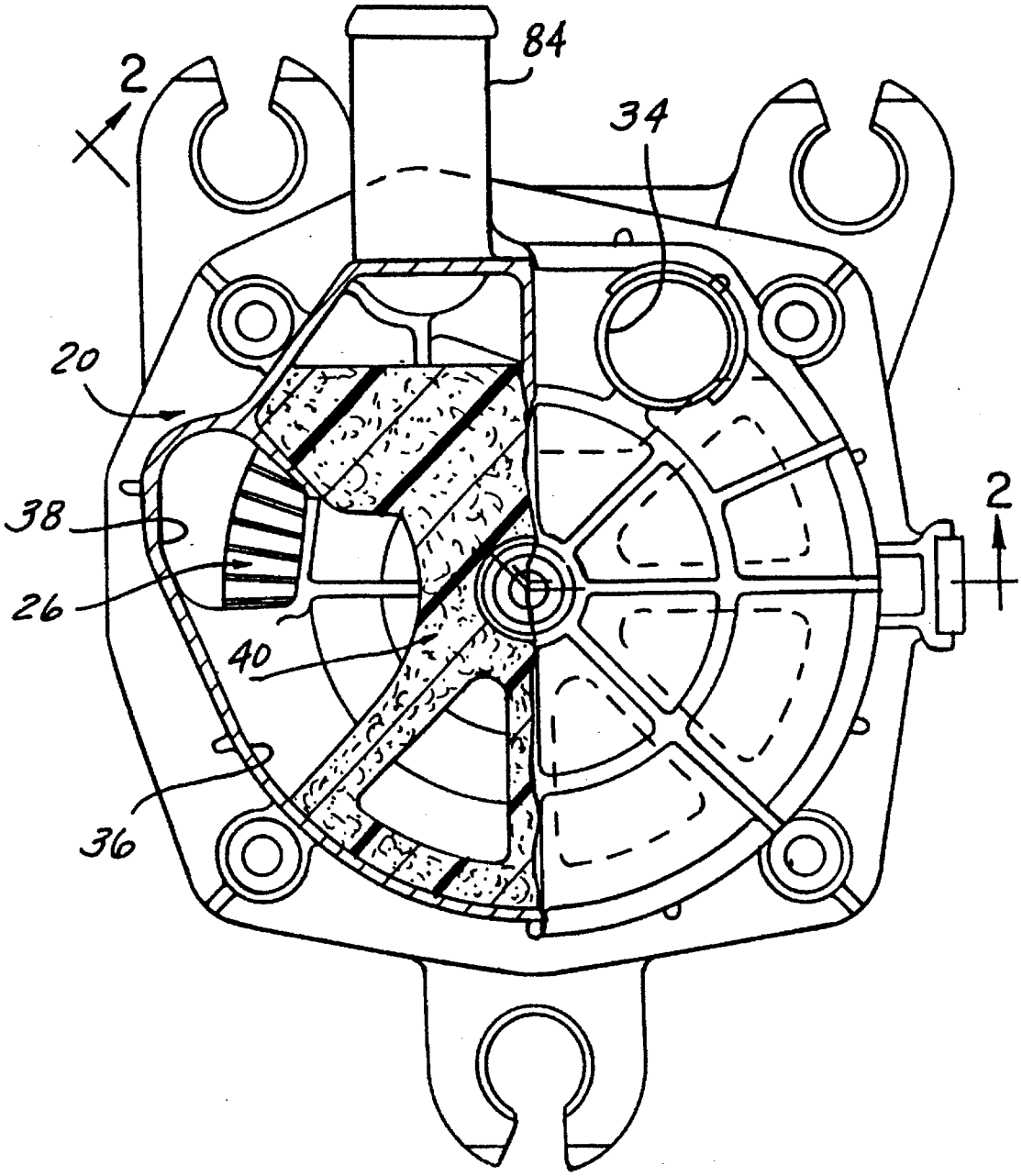
FIG. 1 is a front end view, with certain parts broken away, of a conventional toric pump.
Figure 2:
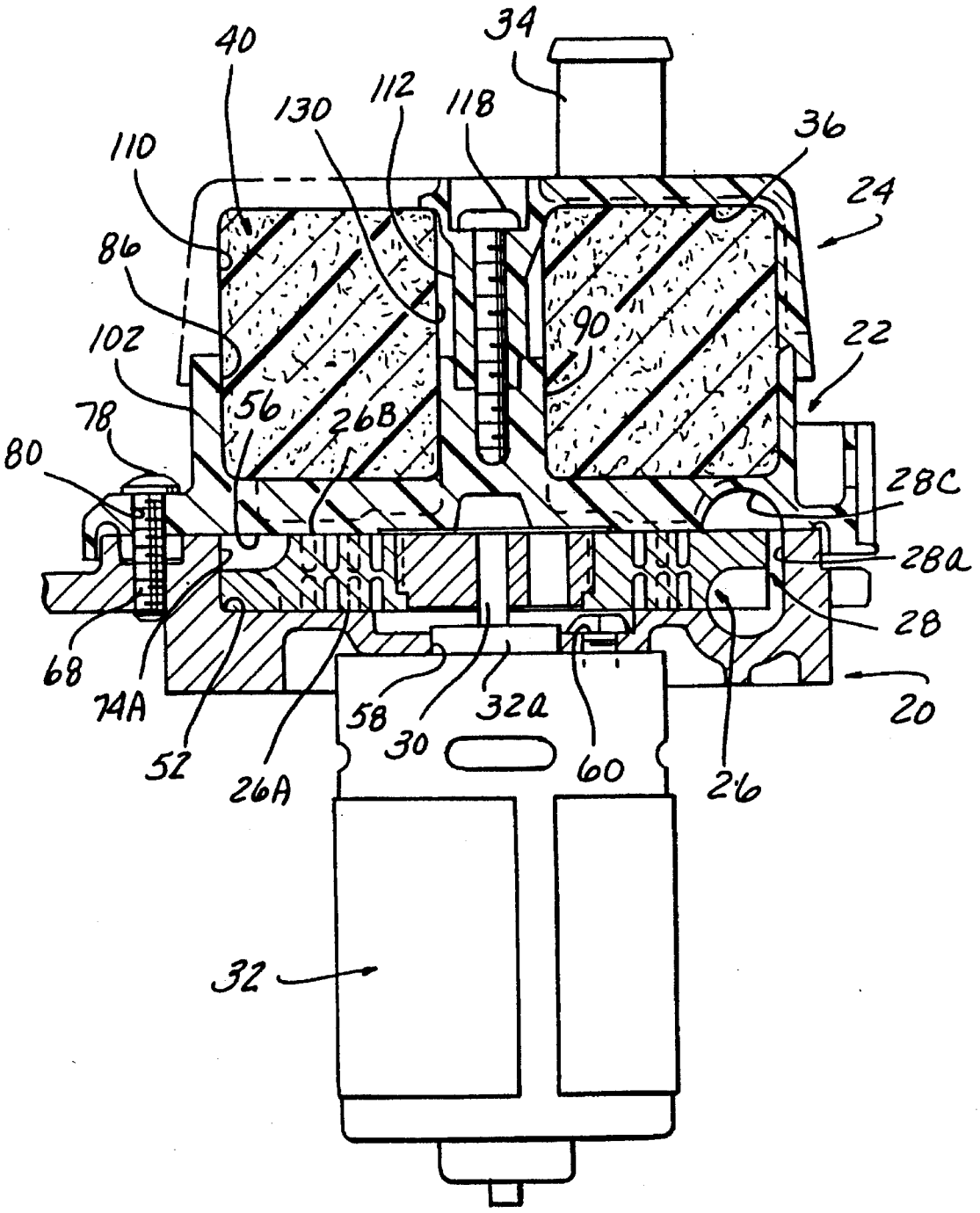
FIG. 2 is a detailed cross sectional view of the pump of FIG. 1 taken on line 2—2 of FIG. 1.

The interrelationship of the various parts of a conventional toric pump or regenerative pump are best seen in the assembly views of FIGS. 1 and 2, while details of the individual parts are shown in FIGS. 3–10.

Referring first to FIGS. 1 and 2, a pump includes an impeller housing designated generally 20, an impeller cover designated generally 22 mounted upon the front of housing 20, and a filter cover designated generally 24 mounted on the front of impeller cover 22. A pump impeller 26 is mounted in operative relationship with a pump chamber designated generally 28 cooperatively defined by the assembled impeller housing 20 and impeller cover 22, the impeller 26 being fixedly coupled to the drive shaft 30 (FIG. 2) of an electric motor 32 mounted or integrated with the rear of the impeller housing. An inlet port or fitting 34 opens through filter cover 24 into a filter chamber 36 defined by the assembled impeller cover and filter cover. A passage or opening in impeller cover 22 places the filter chamber 36 in communication with pump chamber 20, a sponge-like block of filter media 40 being fitted in filter chamber 36 between inlet port 34 and passage 38 to filter air passing into the pump through inlet port 34 before the air passes through passage 38 into pump chamber 28.

For purposes of the present application, the conventional pump impeller 26 and the configuration of pump chamber 28 may be assumed to be identical to the impeller and pump chamber disclosed in U.S. Pat. Nos. 5,302,081, 5,205,707 and/or 5,163,810, and further details of the impeller and pump operation of a conventional pump may be had from those patents, whose disclosure is incorporated herein by reference. The invention of the present application is especially concerned with modifications to the configuration and interrelationship of the impeller and the side channel in the casing, details of which are set forth in detail below with respect to FIGS. 11–19.

Figure 3:
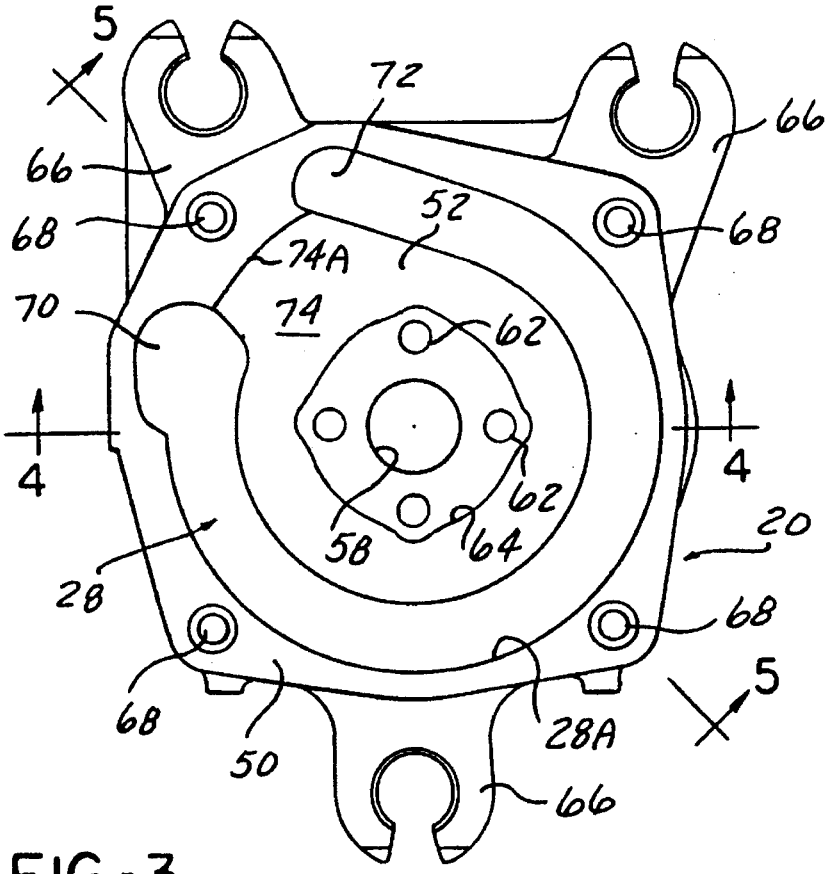
FIG. 3 is a front end view of the impeller housing of the pump of FIG. 1.
Figure 4:
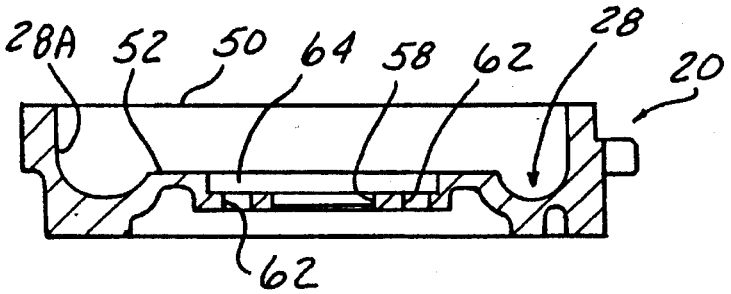
FIG. 4 is a detailed cross sectional view of the impeller housing taken on line 4—4 of FIG. 3.
Figure 5:
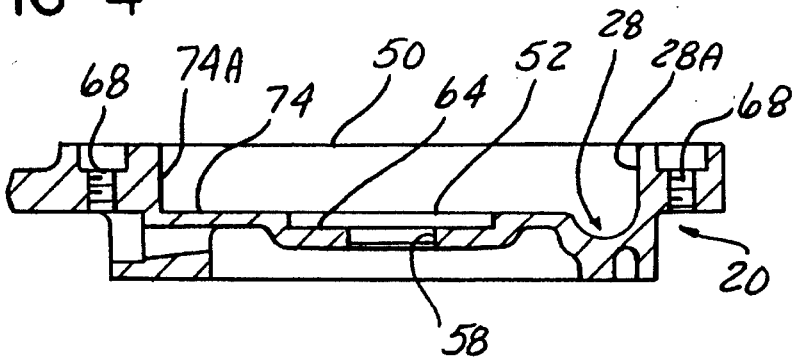
FIG. 5 is a detailed cross sectional view of the impeller housing taken on line 5—5 of FIG. 3.

The construction of impeller housing 20 is best seen in FIGS. 3, 4 and 5. Housing 20 is initially formed as a metal casting with a portion of pump chamber 28 and an impeller receiving recess formed in the casting. Impeller housing 20, if die cast from a suitable material such as SAE 413 aluminum, will require, the machined finishing of only two surfaces and the drilling and tapping of four holes for the reception of mounting bolts.

Referring to FIG. 4, two surfaces which require precise machining are what will be referred to as the front end surface 50 of housing 20 and a parallel surface 52 which defines the bottom of an impeller receiving recess in impeller housing 20. Surfaces 50 and 52 are finished accurately flat and parallel with each other and are spaced axially from each other by a distance which only slightly exceeds the axial thickness of the impeller 26 used. The amount by which the spacing between surfaces 50 and 52 exceeds the impeller thickness establishes the clearance between surface 52 and one side 26A (FIG. 2) of the impeller and between the opposite side 26B of the impeller and an opposed surface 56 of the impeller cover when the impeller, impeller housing and impeller cover are assembled as in FIG. 2. These clearances must be sufficient to avoid rubbing between the impeller sides and housing elements during rotation of the impeller, while at the same time being small enough to minimize any flow of air between the last mentioned opposed surfaces.

A central bore 58 through the impeller housing serves to pilot the front motor boss 32*a* of motor 32 which carries a shaft bearing, not shown, which locates the axis of motor shaft relative to the impeller housing. The location and diameter of bore 58 and the radius of stripper surface 74*a* are the other dimensions (other than surfaces 50 and 52) of housing 20 which must be machined to tight tolerances. The radial outer surface 28*a* of the pump chamber portion of the recess may be established with sufficient precision by the die casting process. Alternatively, bore 58 may receive a shaft bearing directly, rather than a boss on the motor housing in which the shaft bearing is located. Bore 58 establishes the location of the motor shaft axis relative to the housing, stripper surface 74*a* is machined at a precise distance from and concentric to this axis to establish radial clearance between impeller and housing across the stripper. The diameter of bore 58 is such as to receive the motor boss (or shaft bearing) with a transition or locational interference fit. The motor housing is fixedly attached to the rear side of the impeller housing as by bolts 60 (FIG. 2) which pass through bores 62 at the bottom of a central recess 64. Mounting lugs 66 may be integrally formed on housing 20 to enable the pump to be mounted on a suitable mounting bracket. Tapped bores 68 (FIGS. 3 and 5) are formed in housing 20 to accommodate mounting bolts employed to mount impeller cover 22 on impeller housing 20.

As is conventional in toric pumps, the pump chamber 28 extends circumferentially about the axis of the impeller from an inlet end 70 (FIG. 3) to an outlet end 72. The recessed inlet and outlet ends 70, 72 are separated from each other by a stripper portion 74 of surface 52 which, when the impeller is in place, cooperates with the adjacent side surface of the impeller to form a flow restriction between the two surfaces functionally equivalent to a seal between the inlet and outlet. This prevents high pressure air at outlet 72 from flowing across the stripper portion 74 to the low pressure region at inlet end 70.

Figure 6:
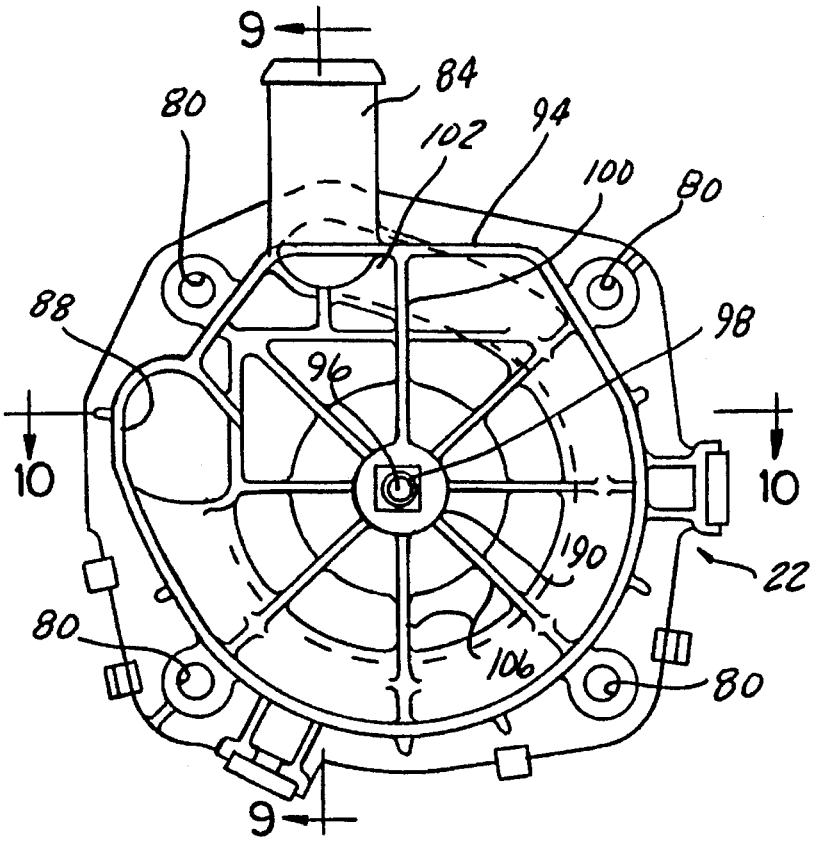
FIG. 6 is a front end view of the impeller cover of the pump of FIG. 1.
Figure 7:
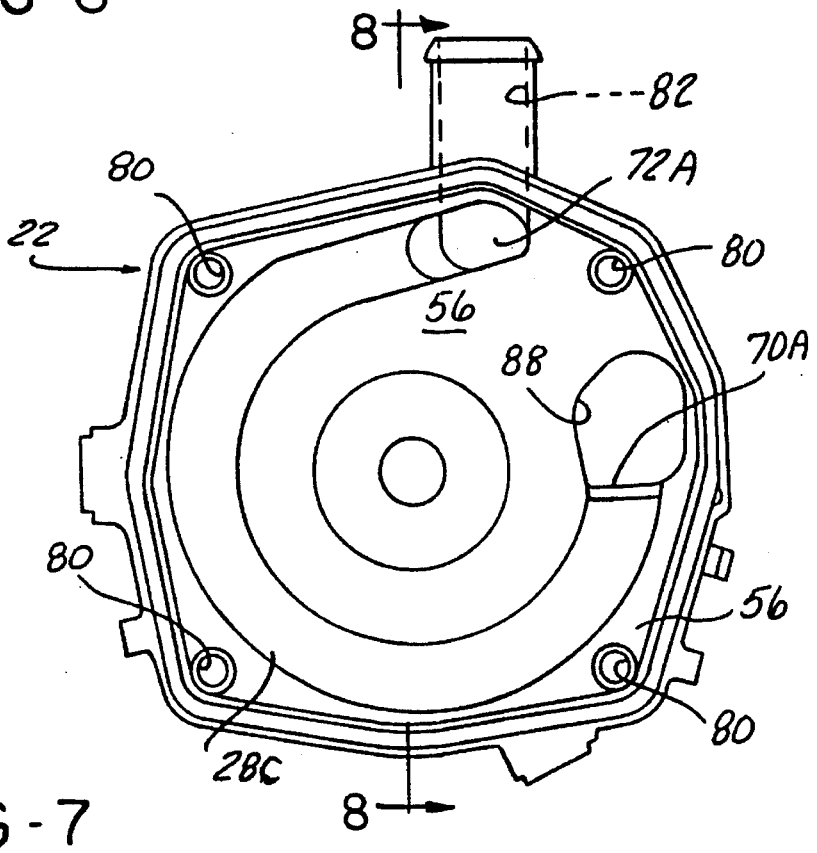
FIG. 7 is a rear end view of the impeller cover.
Figure 9:
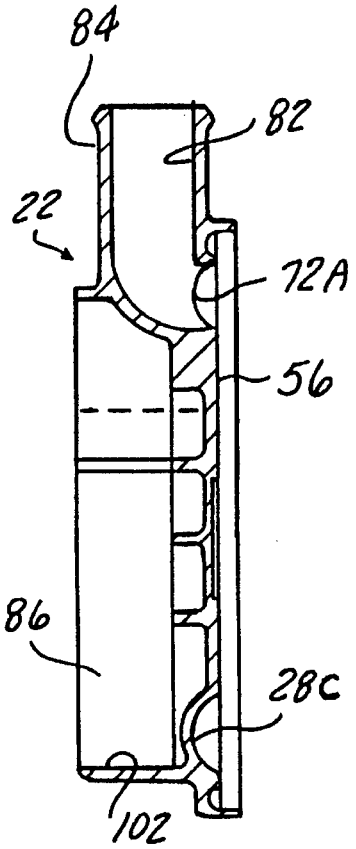
FIG. 9 is a detailed cross sectional view of the impeller cover taken on line 9—9 of FIG. 6.
Figure 10:
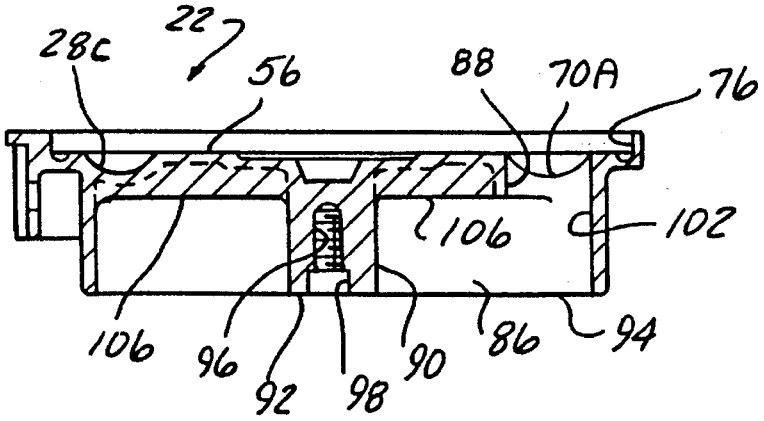
FIG. 10 is a detailed cross sectional view of the impeller cover taken on line 10—10 of FIG. 6.

The structure of impeller cover 22 is best seen in FIGS. 6. Impeller cover 22 is a molded one-piece part of a suitable thermoplastic material. The flat surface 56 referred to above is formed on the rear side of impeller cover 22 to be seated in face to face engagement with the machined surface 50 of impeller housing 20. An annular recess 28C in the flat rear surface 56 forms a pump chamber portion in the rear surface of impeller housing 22 which is coextensive with and matched to pump chamber 28 of housing 20. As best seen in FIGS. 9 and 10, the flat rear surface 56 of the impeller cover is recessed slightly to form an axially projecting peripheral flange 76 which fits over the front end of impeller housing 20 to locate the housing and cover relative to each other upon assembly. As best seen in FIG. 2, bolts 78 passing through bores 80 in impeller cover 22 are received in the tapped bore 68 in impeller housing 20 to fixedly secure housing 20 and cover 22 into assembled relationship with each other. As best seen in FIGS. 7 and 9, the outlet end 72A of the pump chamber portion 28C communicates with a passage 82 extending through a nipple 84 on impeller cover 22 to define an outlet port for the pump chamber 28, 28A, 28C of the pump.

Figure 8:
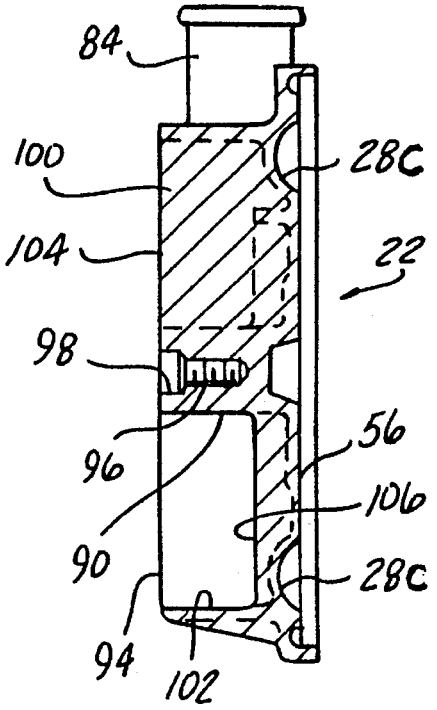
FIG. 8 is a detailed cross sectional view taken on the line 8—8 of FIG. 6.

At the front side of impeller cover 22, a cup shaped recess 86, best seen in FIGS. 9 and 10, is formed. A flow passage 88 leads rearwardly from the bottom of recess 86 to open through the flat rear surface 56 of the impeller cover. Passage 88 opens into the inlet end 70A of the pump chamber portion 28C in impeller cover 22 and constitutes the inlet to the combined pump chamber 28, 28A, 28C of the pump defined by the assembled housing 20 and cover 22. A central post 90 is integrally formed on cover 22 within the recess 86 and projects forwardly to a flat front end 92 co-planar with the front end edge 94 of cover 22. A bore 96 for receiving a self tapping mounting screw extends rearwardly into post 90, with a square recess 98 at the front end of bore 96. A radially extending web 100 (FIGS. 6 and 8) projects radially from central post 100 entirely across recess 86 to be integrally joined to the side wall 102 of the recess. The forward edge 104 (FIG. 8) of web 100 is co-planar with the front edge 94 of the impeller cover. Other stiffening webs such as 106 may be formed at appropriate locations in recess 86 but, as best seen in FIG. 8, these other webs 106 have edges which are spaced well rearwardly of front edge 94. Recess 86 constitutes a portion of a filter chamber adapted to receive filter 40 (see FIG. 2). Cover 24 is of a generally cup shaped configuration, the recess 110 of the cup opening rearwardly. The recess 110 in filter cover 24 is conformed to mate with and form an extension of the filter receiving recess 86 of impeller cover 22, as seen in FIG. 2. Like impeller cover 22, a central post 112 is formed in the filter receiving recess 110. A bore through post 112 receives a mounting bolt 118 threaded into bore 96 in the impeller cover to hold the filter cover seated on the impeller cover 22. The filter element designated generally 40 is formed from a block of a sponge-like material, such as a reticulated polyester foam. The axial thickness of filter element 40 is chosen to slightly exceed the axial dimension of the filter chamber defined by the mated filter receiving recesses 86, 110 of the impeller cover 22 and filter cover 24 when the two covers are assembled. Filter element 40 is formed with a central bore 130 adapted to receive central posts 90 and 112, as seen in FIG. 2.

Figure 11:
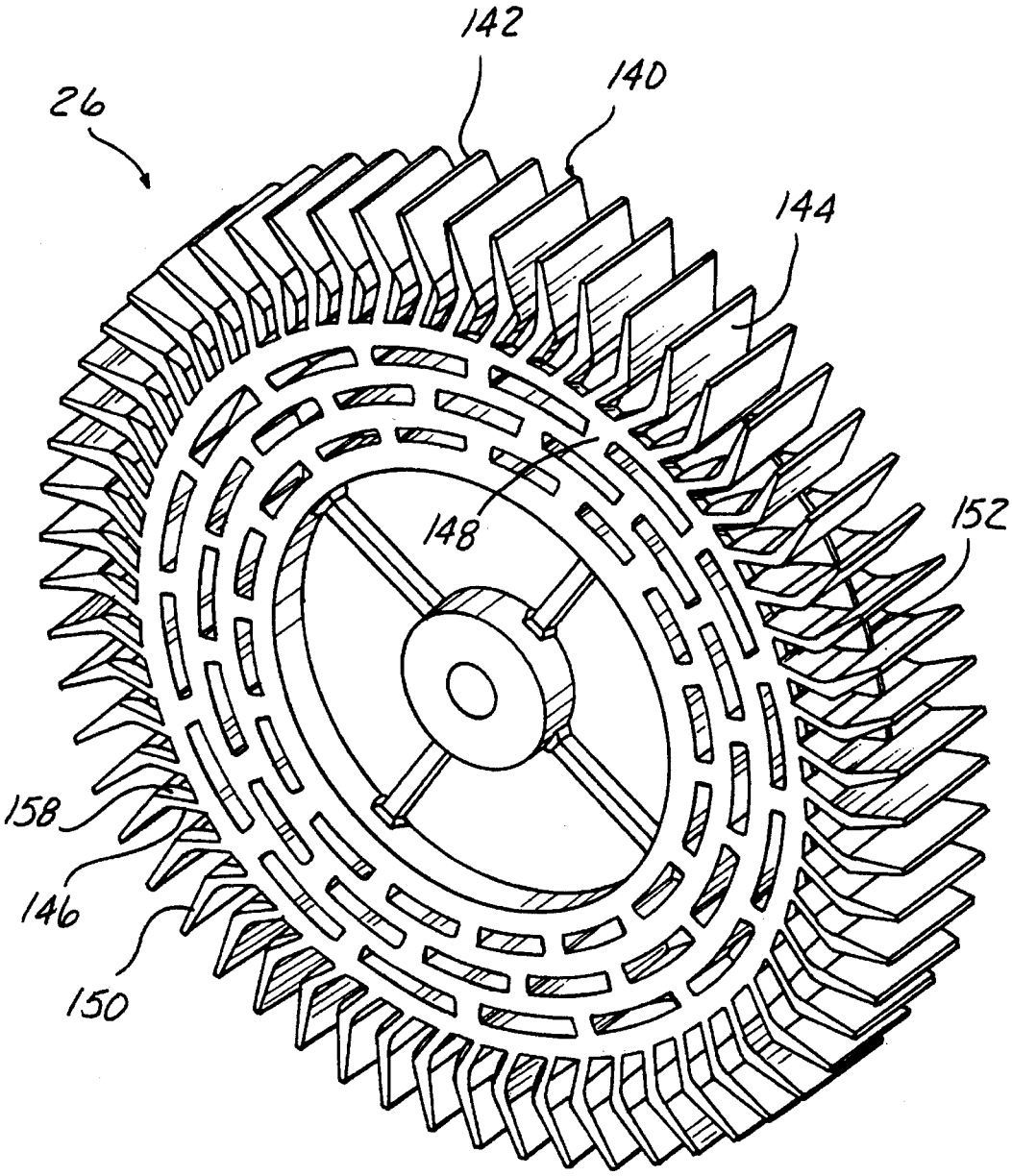
FIG. 11 is a perspective view of an impeller according to the present invention.
Figure 12:
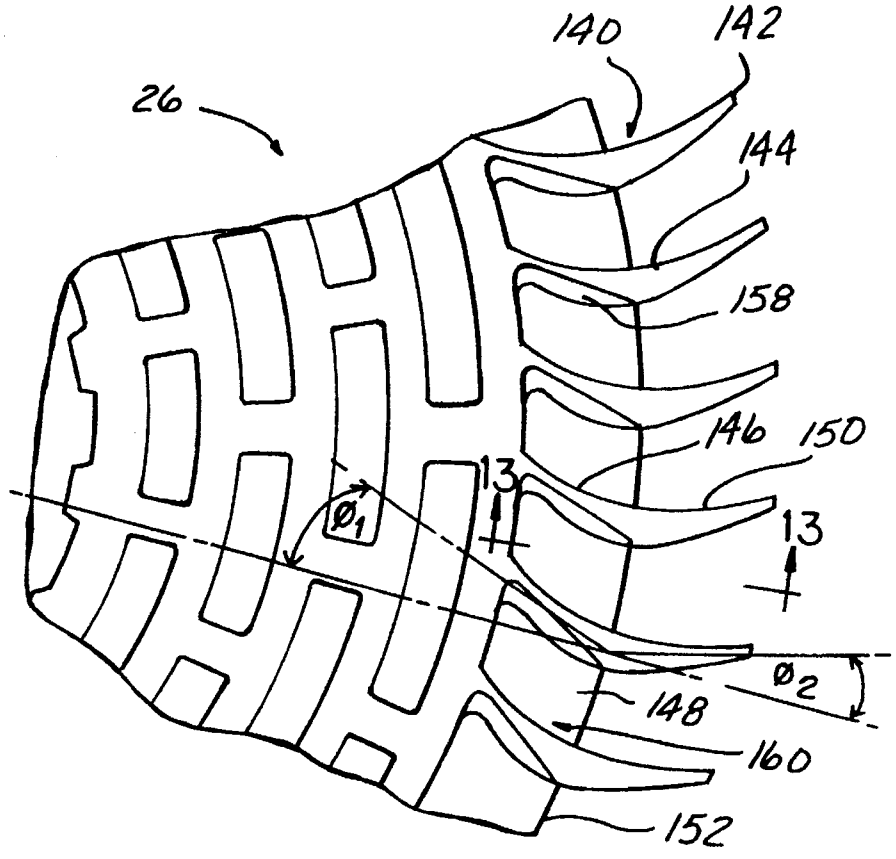
FIG. 12 is a detailed view of a portion of an impeller according to the present invention.
Figure 13:
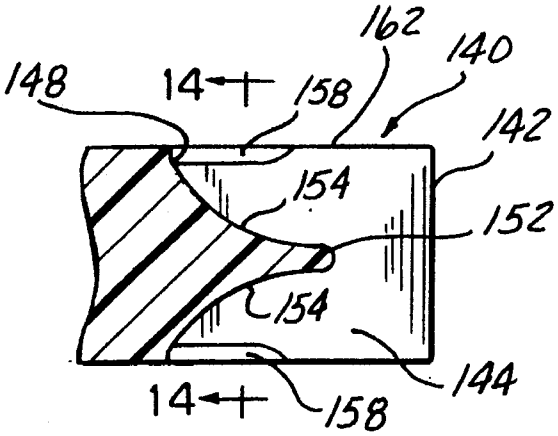
FIG. 13 is a cross-sectional detailed view of the impeller taken on line 13—13 of FIG. 12.
Figure 14:
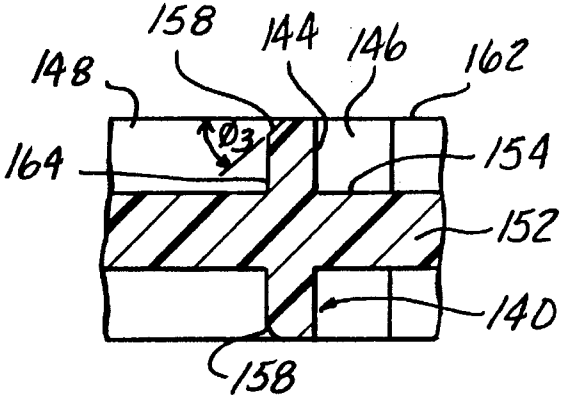
FIG. 14 is a cross-sectional detailed view of the impeller taken on line 14—14 of FIG. 13.

The pump impeller 26 can be modified from the conventional straight radially extending vanes to a bent shape of vane as illustrated in FIG. 11 or a curvilinear form as illustrated in FIGS. 12–14. In any case, the pump impeller 26 includes axially and radially extending blade means 140 formed on an outer radial periphery 142 of the impeller 26 for driving fluid from the inlet end 70 toward the outlet end 72 as the impeller 26 rotates about the axis of rotation. The blade means 140 includes a plurality of vanes 144 spaced circumferentially around the outer radial periphery 142 of the impeller 26. Each vane 144 has a radially inward base portion 146 connected to an axially extending cylindrical sidewall or hub 148 of the impeller 26. The base portion 146 extends in a generally trailing direction with respect to rotation of the impeller 26. As illustrated in FIG. 11, the impeller would rotate in a counter-clockwise direction. A radially outward tip portion 150 of each vane 144 extends in a generally leading direction with respect to rotation of the impeller 26. The base portion 146 forms an entry angle $\phi_1$ with respect to a radially extending plane containing the axis of rotation of the impeller 26 in a range selected from between 20° and 30° inclusive, with a preferable range selected from between 26° and 30° inclusive, and a most preferred angle of 26°. The tip portion 150 forms an exit angle $\phi_2$ with respect to a radially extending plane containing the axis of rotation of the impeller 26 in a range selected from between 20° and 45° inclusive, with a preferable range selected from between 20° and 30° inclusive, and a most preferred angle of 20°. The blade means 140 preferably includes a plurality of vanes spaced circumferentially around the outer radial periphery 142 of the impeller 26 with each vane 144 bent or curved in radial direction with respect to the axis of rotation of the impeller 26 about an axis generally parallel with the axis of rotation. The blade means 140 may include at least one set of radially bent vanes 144 with respect to the axis of rotation, where the set of vanes 144 is defined by at least two circumferentially spaced vanes 144 cooperating with one another to form a single circular annulus. As best seen in FIGS. 11–14, the impeller 26 preferably includes a generally radially extending planar web 152 disposed normal to the axis of rotation and connected to the blade means 140. The web 152 extends at least radially outwardly from the axially extending, cylindrical sidewall or hub 148 of the impeller 26. Preferably, the transition surface 154 formed between the web 152 and the annular hub 148 of the impeller 26 is filled in to provide an angled, stepped, or most preferably a radially curved transition surface 154 between the axially extending hub 148 of the impeller 26 and the radially extending web 152 between each adjacent set of vanes 144. The web 152 preferably extends radially into the blade means 140 to a position generally midway between the base portion 146 and the tip portion 150 of each vane 144. If the web 152 is extended radially outwardly to the outer radial periphery 142 of the impeller 26 (not shown), each vane 144 can be axially separated or isolated from one another if desired for a particular application. It has been found that optimum performance characteristics are achieved if the web 152 is maintained at a position located between the base portion 146 and a tip portion 150 of each vane, and preferably at a position generally midway between the base portion 146 and the tip portion 150. It should be recognized that the base portion 146 may be of the same, or a differing length, with respect to the tip portion 150 of each vane 144. Preferably, the base portion 146 forms a percentage of the overall radial length of each vane 144 in a range selected from between 30% and 70% inclusive, with a preferable range of 40% to 60% inclusive and a most preferable value of approximately 50%. Preferably, each vane 144 is identical with the other corresponding vanes 144 formed on the outer radial periphery 142 of the impeller 26.

Chamfer means 158 is preferably formed on the base portion 146 of each vane 144 for deflecting fluid from the inlet toward a pocket 160 defined between two adjacent vanes 144 and the casing sidewalls defining the pump chamber 28. The chamfer means 158 is preferably formed on a trailing edge of the base portion 146. The chamfer means 158 can be formed at an angle $\phi_3$ with respect to a radially extending plane normal to the axis of rotation of the impeller at a range selected from between 10° and 45° inclusive, with a preferred value of approximately 45°. The chamfer means 148 could also be formed as a curved or radial surface (not shown) having a predetermined radius connecting a generally radially extending surface 162 of the vane 144 to a generally axially extending surface 164 of the vane 144 along a trailing edge.

Figure 15:
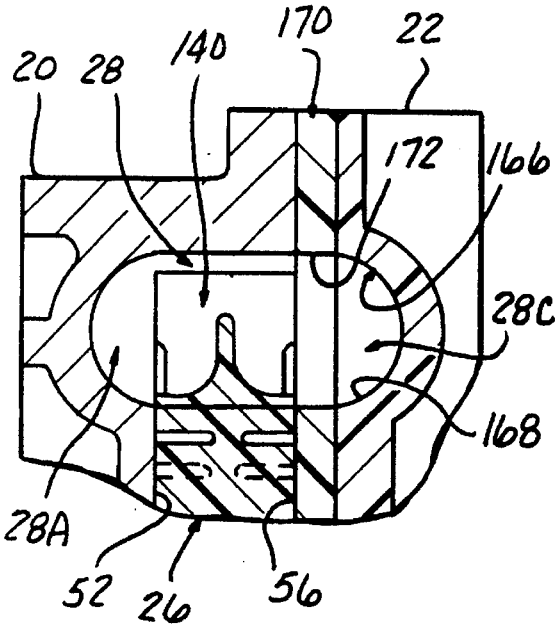
FIG. 15 is a cross-sectional detailed view of an asymmetrical pump chamber formed with a spacer according to the present invention.
Figure 16:
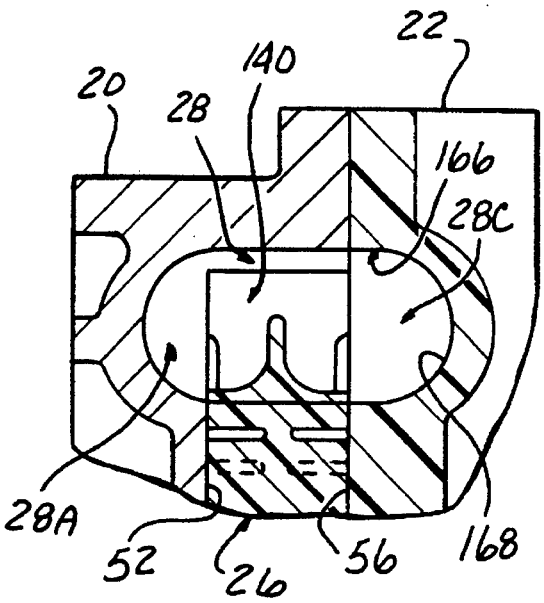
FIG. 16 is a cross-sectional detailed view of an asymmetrical pump chamber according to the present invention formed integrally in the impeller cover.

Fluid directing means 166 is preferably formed in at least one sidewall of the casing defining the pump chamber 28 for directing fluid back toward the impeller 26. The fluid directing means 166 preferably takes the form of a fixed surface 168 defining a portion of the pump chamber 28. The fluid directing means 166 can include at least one of the first and second sidewalls 52, 56 having a generally ring-shaped, side channel portion 28A, 28C formed in the casing around the axis of rotation for directing fluid helically back into contact with the blade means 140 as the impeller 26 rotates. The side channel portion 28A or 28C is generally perpendicular to the axis of rotation and extends along an arc of constant radius centered on the axis of rotation. The fluid directing means 166 may also include each of the first and second sidewalls 52, 56 having generally ring-shaped side channel portion 28A, 28C respectively formed therein around the axis of rotation for directing fluid helically back into contact with the blade means 140 as the impeller 26 rotates. In the preferred configuration, as best seen in FIGS. 15 and 16, the fluid directing side channel portion 28C of one of the first and second sidewalls 52, 56 is enlarged with respect to the other fluid directing side channel portion 28A. Preferably, the enlarged fluid directing side channel portion 28C is enlarged in the axial direction. The axial enlargement can be accomplished by placing a spacer 170 between the impeller housing 20 and the impeller cover 22, as best seen in FIG. 15. The spacer 170 is formed to extend the wall defining the side channel portion 28C in axial direction with sidewall extension 172. The sidewall extension 172 is formed to closely follow the contour of the side channel portion 28C of the pump chamber 28 formed in the impeller cover 22. Of course, it should be recognized that the combination of the spacer 170 and impeller cover 22 can be replaced with a unitary impeller cover 22 formed with the appropriate enlarged side channel portion 28C, as is illustrated in FIG. 16. The fluid directing means 166 preferably is formed asymmetrically in the first and second side walls 52, 56 of the casing.

Figure 17:
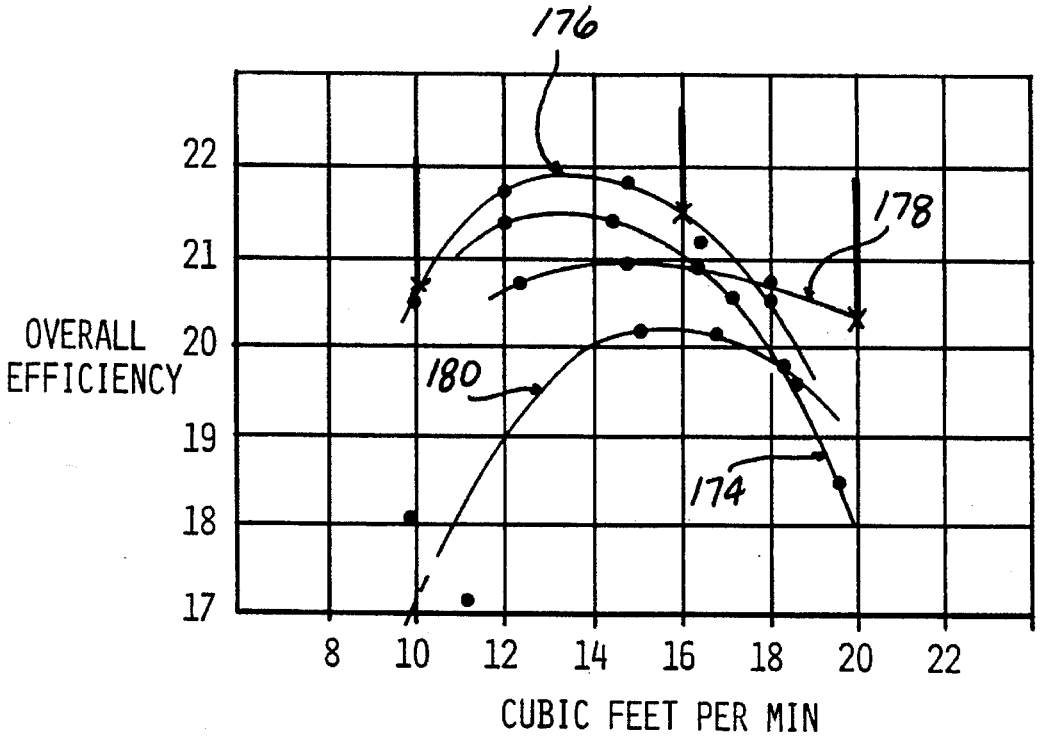
FIG. 17 is a graph of overall efficiency versus flow rate in cubic feet per minute at 40 inches of water back pressure showing various curves for different size spacers.

FIG. 17 is a graph of an extended range electrical air pump according to the present invention showing overall pump efficiency versus flow rate in standard cubic feet per minute at 40 inches $H_2O$ back pressure with an 85 mm diameter impeller, no filter and powered by 13.5 volt power source. The various curves show operating characteristics for different sizes of spacers placed between the impeller housing 20 and the impeller cover 22. The first curve 174 illustrates the device with no spacer interposed between the impeller housing 20 and the impeller cover 22. The second curve 176 illustrates the performance characteristics of the modified pump with a spacer having a thickness of 1.0 mm. The third curve 178 illustrates the performance characteristics of the pump with a 1.5 mm spacer interposed between the housing 20 and the cover 22 disclosed as illustrated in FIG. 15. The fourth curve 180 illustrates the performance characteristics of the pump with a 2.5 mm spacer between the impeller housing 20 and the impeller cover 22. Each of these curves were obtained through the use of a prototype configuration including the arcuate vanes 144 as described in greater detail above with an entry angle of 26° an exit angle of 30° and a 45° chamfer on the trailing edge of the base portion of the vane. The test results are summarized in the table below.

| SCFM FLOW AT 40 INCH $H_2O$ | BEST CHOICE SPACER | OVERALL EFFICIENCY | RPM | AMPS |
|---|---|---|---|---|
| 10 | 1.0 mm | 20.75 | 13,460 | 16.8 |

-continued

| SCFM FLOW AT 40 INCH $H_2O$ | BEST CHOICE SPACER | OVERALL EFFICIENCY | RPM | AMPS |
|---|---|---|---|---|
| 16 | 1.0 mm | 21.5 | 16,430 | 28.5 |
| 20 | 1.5 mm | 20.3 | 18,300 | 33.5 |

Figure 18:
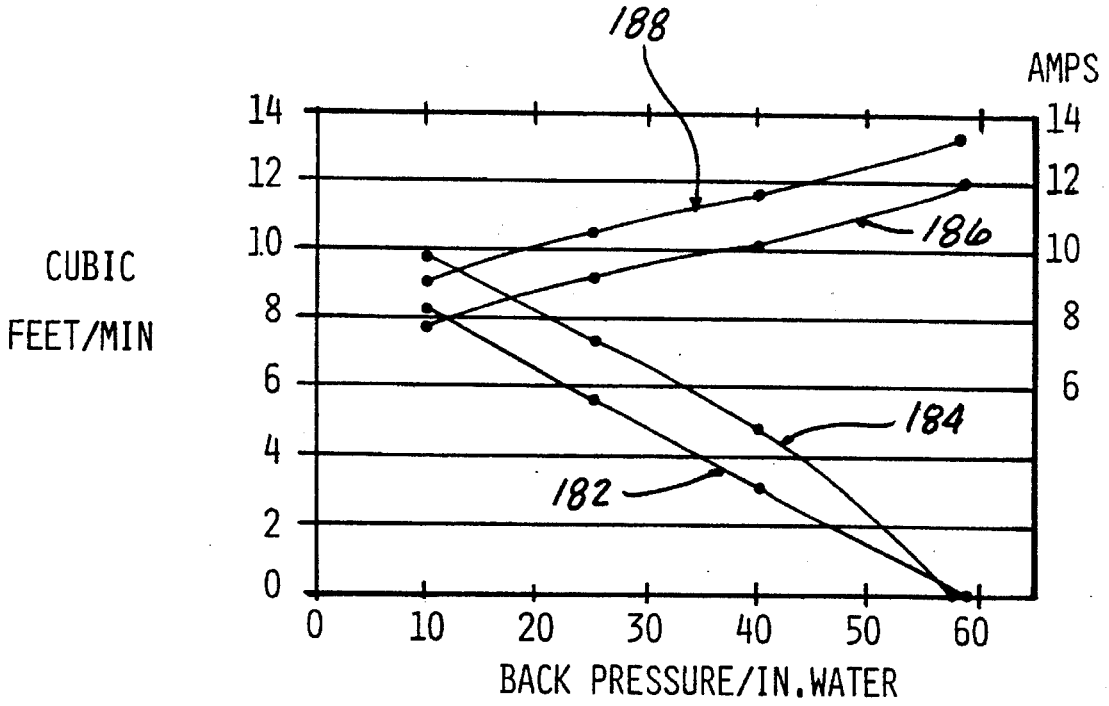
FIG. 18 is a graph of flow rate in cubic feet per minute versus back pressure in inches of water showing flow lines comparing pump chambers with and without spacers, and corresponding electrical current lines of the pump with and without a spacer.

FIG. 18 is a graph of flow in cubic feet per minute versus back pressure in inches of water and further showing the current in amps versus back pressure in inches of water. The first line 182 shows flow characteristics of a pump according to the present invention without a spacer, while the second line 184 shows the fluid flow characteristics of the pump with a spacer of 2.5 mm in size. The third line 186 depicts the current used by the pump when operated without a space corresponding to the fluid flow of the first line 182 while the fourth line 188 corresponds to the current flow through the pump with a spacer corresponding to the fluid flow characteristics of the second line 184. The data obtained for a back pressure of 10 inches of water was at 15,337 revolutions per minute (RPM), while the data points for approximately 25 inches back pressure were at 15,075 revolutions per minute (RPM). The data points corresponding to 40 inches of back pressure and 60 inches of back pressure were obtained at 14,860 revolutions per minute (RPM) and 14,319 revolutions per minute (RPM) respectively. Each of these curves were obtained through the use of a prototype configuration including the arcuate vanes 144 as described in greater detail above with an entry angle of 26°, an exit angle of 30° and a 45° chamfer on the trailing edge of the base portion of the vane, with an 85 mm diameter impeller, no filter and powered by 13.5 volt power source.

Figure 19:
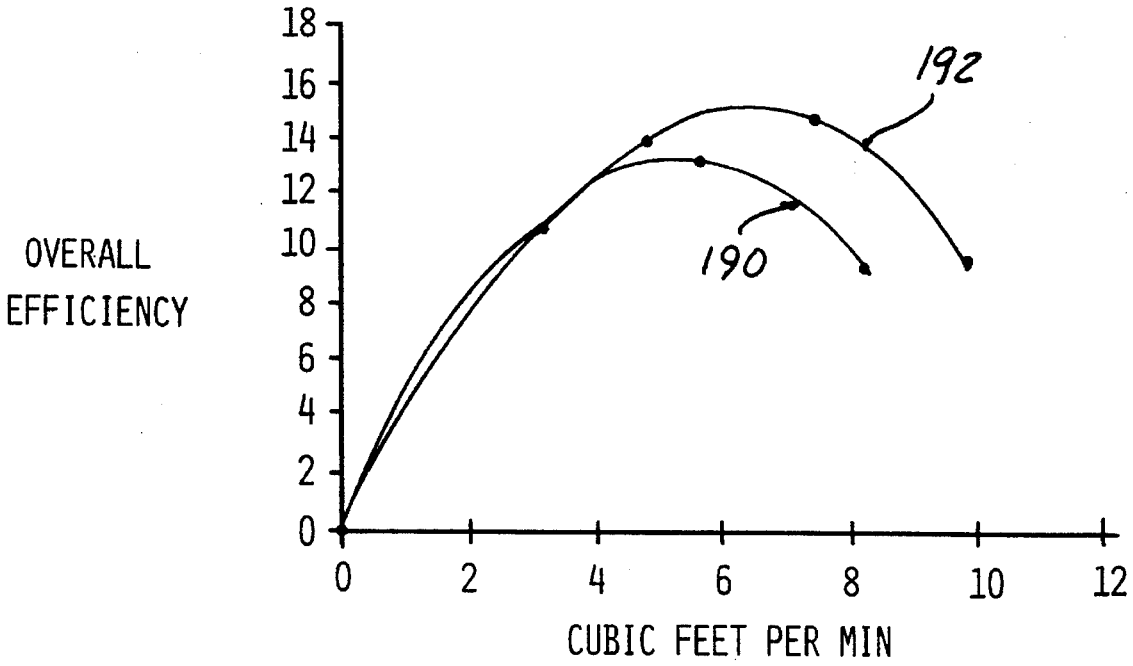
FIG. 19 is a graph of overall efficiency versus flow in standard cubic feet per minute showing curves comparing pump chambers with and without a spacer.

FIG. 19 is a graph depicting overall efficiency in percent versus flow in standard cubic feet per minute. The first or lower curve 190 illustrates the pump characteristics without a spacer, while the upper or second curve 192 illustrates the pump characteristics with a spacer of a size of 2.5 mm. The plotted data points along each curve starting from the right or highest flow rate proceeding toward the lower flow rate correspond to 10 inches, 25 inches and 40 inches ($H_2O$) back pressure respectively along each of the two curves, 190 and 192. Each of these curves were obtained through the use of a prototype configuration including the arcuate vanes 144 as described in greater detail above with an entry angle of 26°, an exit angle of 30° and a 45° chamfer on the trailing edge of the base portion of the vane, with an 85 mm diameter impeller, no filter and powered by 13.5 volt power source.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A regenerative pump for adding energy to a fluid comprising:

an impeller having an axis of rotation and axially spaced, radially extending first and second surfaces;

a casing enclosing the impeller and having a fluid inlet and a fluid outlet separated by a stripper, the casing having axially spaced, radially extending first and second side walls, said first and second side walls facing said first and second surfaces of said impeller respectively;

axially and radially extending blade means formed on an outer radial periphery of said impeller for driving fluid from said inlet toward said outlet as said impeller rotates about said axis of rotation, said blade means including a radially inward base portion extending in a generally trailing direction with respect to rotation of said impeller and a radially outward tip portion extending in a generally leading direction with respect to rotation of said impeller;

said blade means including a plurality of vanes spaced circumferentially around the outer radial periphery of said impeller and each vane having said base portion and said tip portion formed thereon;

chamfer means formed on said base portion of each vane for deflecting fluid from said inlet toward a pocket defined between two adjacent vanes and said casing, said chamfer means formed as a curved surface having a predetermined radius connecting a generally radially extending surface of said vane to a generally axially extending surface of said vane along a trailing edge; and means formed in at least one side wall of said casing for directing fluid back toward said impeller.

2. The regenerative pump of claim 1 further comprising:

said chamfer means formed at an angle with respect to a radially extending plane normal to said axis of rotation of said impeller in a range selected from between 10° and 45° inclusive.

3. The regenerative pump of claim 1 further comprising:

said base portion forming an entry angle with respect to a radially extending plane containing said axis of rotation of said impeller in a range selected from between 20° and 30° inclusive.

4. The regenerative pump of claim 3 further comprising:

said tip portion forming an exit angle with respect to a radially extending plane containing said axis of rotation of said impeller in a range selected from between 20° and 45° inclusive.

5. The regenerative pump of claim 1 further comprising:

said impeller having a generally radially extending planar web normal to said axis of rotation and connected to said blade means, said web extending radially into said blade means to a position generally midway between a base and a tip of each vane.

6. The regenerative pump of claim 5 further comprising:

a gradual, transitional, radially and axially extending surface disposed between said web and said impeller and between each pair of adjacent vanes.

7. The regenerative pump of claim 1 further comprising:

said fluid directing means including at least one of said first and second side walls having a generally ring shaped, side channel portion formed in said casing around said axis of rotation for directing fluid helically back into contact with said blade means as said impeller rotates.

8. The regenerative pump of claim 7 further comprising:

said side channel portion generally perpendicular to and along an arc of constant radius centered on said axis of rotation.

9. The regenerative pump of claim 1 further comprising:

said fluid directing means including each of said first and second side walls having a generally ring shaped side channel portion formed therein around said axis of rotation for directing fluid helically back into contact with said blade means as said impeller rotates.

10. The regenerative pump of claim 1 further comprising:

said fluid directing means including each of said first and second side walls having a generally ring shaped, side channel portion formed therein around said axis of rotation for directing fluid helically back into contact with said blade means as said impeller rotates, wherein the fluid directing side channel portion of one of said first and second side walls is enlarged with respect to the other fluid directing side channel portion.

11. The regenerative pump of claim 1 further comprising:

said fluid directing means formed asymmetrically in said first and second side walls of said casing around said axis of rotation for directing fluid helically back into contact with said blade means as said impeller rotates.

12. The regenerative pump of claim 1 further comprising:

said casing radially split and including an impeller housing and an impeller cover; and said fluid directing means including a spacer having a side channel wall extension for placement between said impeller housing and said impeller casing to form an asymmetrical side channel pump chamber for directing fluid helically back into contact with said blade means as said impeller rotates.

13. A regenerative pump for adding energy to a fluid comprising:

an impeller having an axis of rotation and axially spaced, radially extending first and second surfaces;

a casing enclosing the impeller and having a fluid inlet and a fluid outlet separated by a stripper, the casing having axially spaced, radially extending first and second side walls, said first and second side walls facing said first and second surfaces of said impeller respectively;

axially and radially extending blade means formed on an outer radial periphery of said impeller for driving fluid from said inlet toward said outlet as said impeller rotates about said axis of rotation, said blade means including a plurality of vanes spaced circumferentially around the outer radial periphery of said impeller and each vane having a radially inward base portion extending in a generally trailing direction with respect to rotation of said impeller and a radially outward tip portion extending in a generally leading direction with respect to rotation of said impeller;

chamfer means formed on said base portion of each vane for deflecting fluid from said inlet toward a pocket defined between two adjacent vanes and said casing;

said chamfer means formed on a trailing edge of said base portion as a curved surface having a predetermined radius connecting a generally radially extending surface of said vane to a generally axially extending surface of said vane along a trailing edge; and means formed in at least one side wall of said casing for directing fluid back toward said impeller.

14. The regenerative pump of claim 13 further comprising:

said chamfer means formed at an angle with respect to a radially extending plane normal to said axis of rotation of said impeller in a range selected from between 10° and 45° inclusive.

15. The regenerative pump of claim 13 further comprising:

said base portion forming an entry angle with respect to a radially extending plane containing said axis of rotation of said impeller in a range selected from between 20° and 30° inclusive.

16. The regenerative pump of claim 13 further comprising:

said tip portion forming an exit angle with respect to a radially extending plane containing said axis of rotation of said impeller in a range selected from between 20° and 45° inclusive.

17. The regenerative pump of claim 13 further comprising:

said impeller having a generally radially extending planar web normal to said axis of rotation and connected to said blade means, said web extending radially into said blade means to a position generally midway between a base and a tip of each vane.

18. The regenerative pump of claim 17 further comprising:

a gradual, transitional, radially and axially extending surface disposed between said web and said impeller and between each pair of adjacent vanes.

19. The regenerative pump of claim 13 further comprising:

said blade means including a plurality of vanes spaced circumferentially around the outer radial periphery of said impeller and each vane bent in radial direction with respect to said axis of rotation of said impeller about an axis generally parallel with said axis of rotation.

20. The regenerative pump of claim 13 further comprising:

said fluid directing means formed asymmetrically in said first and second side walls of said casing around said axis of rotation for directing fluid helically back into contact with said blade means as said impeller rotates.

21. The regenerative pump of claim 20 further comprising:

said fluid directing means including each of said first and second side walls having a generally ring shaped, side channel portion formed therein around said axis of rotation for directing fluid helically back into contact with said blade means as said impeller rotates, wherein the fluid directing side channel portion of one of said first and second side walls is axially enlarged with respect to the other fluid directing side channel portion.

22. The regenerative pump of claim 20 further comprising:

said casing radially split and including an impeller housing and an impeller cover; and said fluid directing means including a spacer having a side channel wall extension for placement between said impeller housing and said impeller casing to form an asymmetrical side channel pump chamber for directing fluid helically back into contact with said blade means as said impeller rotates.

23. A regenerative pump for adding energy to a fluid comprising:

an impeller having an axis of rotation and axially spaced, radially extending first and second surfaces;

a casing enclosing the impeller and having a fluid inlet and a fluid outlet separated by a stripper, the casing having axially spaced, radially extending first and second side walls, said first and second side walls facing said first and second surfaces of said impeller respectively;

axially and radially extending blade means formed on an outer radial periphery of said impeller for driving fluid from said inlet toward said outlet as said impeller rotates about said axis of rotation; and means formed in at least one side wall of said casing for directing fluid back toward said impeller, said fluid directing means formed asymmetrically in said first and second side walls of said casing around said axis of rotation for directing fluid helically back into contact with said blade means as said impeller rotates.

24. The regenerative pump of claim 23 further comprising:

said blade means including at least one set of radially straight vanes, said set of vanes defined by at least two circumferentially spaced vanes cooperating with one another to form a single circular annulus.

25. The regenerative pump of claim 23 further comprising:

said fluid directing means including each of said first and second side walls having a generally ring shaped, side channel portion formed therein around said axis of rotation for directing fluid helically back into contact with said blade means as said impeller rotates, wherein the fluid directing side channel portion of one of said first and second side walls is axially enlarged with respect to the other fluid directing side channel portion.

26. The regenerative pump of claim 23 further comprising:

said casing radially split and including an impeller housing and an impeller cover; and said fluid directing means including a spacer having a side channel wall extension for placement between said impeller housing and said impeller casing to form an asymmetrical side channel pump chamber for directing fluid helically back into contact with said blade means as said impeller rotates.

27. The regenerative pump of claim 23 further comprising:

said blade means including a plurality of vanes spaced circumferentially around the outer radial periphery of said impeller and each vane having a radially inward base portion extending in a generally trailing direction with respect to rotation of said impeller and a radially outward tip portion extending in a generally leading direction with respect to rotation of said impeller.

28. The regenerative pump of claim 27 further comprising:

chamfer means formed on said base portion of each vane for deflecting fluid from said inlet toward a pocket defined between two adjacent vanes and said casing.

29. The regenerative pump of claim 28 further comprising:

said chamfer means formed on a trailing edge of said base portion.

30. The regenerative pump of claim 29 further comprising:

said chamfer means formed at an angle with respect to a radially extending plane normal to said axis of rotation of said impeller in a range selected from between 10° and 45° inclusive.

31. The regenerative pump of claim 29 further comprising:

said chamfer means formed as a curved surface having a predetermined radius connecting a generally radially extending surface of said vane to a generally axially extending surface of said vane along a trailing edge.

32. The regenerative pump of claim 27 further comprising:

said base portion forming an entry angle with respect to a radially extending plane containing said axis of rotation of said impeller in a range selected from between 20° and 30° inclusive.

33. The regenerative pump of claim 27 further comprising:

said tip portion forming an exit angle with respect to a radially extending plane containing said axis of rotation of said impeller in a range selected from between 20° and 45° inclusive.

34. The regenerative pump of claim 27 further comprising:

said impeller having a generally radially extending planar web normal to said axis of rotation and connected to said blade means, said web extending radially into said blade means to a position generally midway between a base and a tip of each vane.

35. The regenerative pump of claim 34 further comprising:

a gradual, transitional, radially and axially extending surface disposed between said web and said impeller and between each pair of adjacent vanes.

36. The regenerative pump of claim 27 further comprising:

said blade means including a plurality of vanes spaced circumferentially around the outer radial periphery of said impeller and each vane bent in radial direction with respect to said axis of rotation of said impeller about an axis generally parallel with said axis of rotation.

* * * * *

US005527149C1

(12) EX PARTE REEXAMINATION CERTIFICATE (7716th)

United States Patent
Moss et al.

(10) Number: US 5,527,149 C1
(45) Certificate Issued: Sep. 7, 2010

(54) EXTENDED RANGE REGENERATIVE/PUMP WITH MODIFIED IMPELLER AND/OR HOUSING

(75) Inventors: Norman Moss, St. Clair Shores, MI (US); Robert S. Czarnowski, Oxford, MI (US)

(73) Assignee: Wells Fargo Foothill, Inc., Boston, MA (US)

Reexamination Request:
No. 90/009,632, Nov. 4, 2009

Reexamination Certificate for:

| | |
|---|---|
| Patent No.: | **5,527,149** |
| Issued: | **Jun. 18, 1996** |
| Appl. No.: | **08/253,543** |
| Filed: | **Jun. 3, 1994** |

(51) Int. Cl.
*F04D 5/00* (2006.01)
*F04D 29/40* (2006.01)

(52) U.S. Cl. ..... 415/55.1; 415/912
(58) Field of Classification Search ..... None
See application file for complete search history.

(56) References Cited

U.S. PATENT DOCUMENTS

| | | | |
|---|---|---|---|
| 5,299,908 | A | 4/1994 | Robbie |
| 5,310,308 | A | 5/1994 | Yu et al. |
| 5,407,318 | A | 4/1995 | Ito et al. |

FOREIGN PATENT DOCUMENTS

| | | |
|---|---|---|
| GB | 673796 | 6/1952 |

*Primary Examiner*—William C Doerrler

(57) ABSTRACT

A regenerative or toric pump adds energy to a fluid using an impeller having an axis of rotation and axially spaced, radially extending first and second surfaces. A casing encloses the impeller and has a fluid inlet and a fluid outlet separated by a stripper. The casing has axially spaced, radially extending first and second sidewalls facing the first and second surfaces of the impeller respectively. Axially and radially extending blades or vanes are formed on an outer radial periphery of the impeller for driving fluid from the inlet toward the outlet as the impeller rotates about the axis of rotation. A fixed surface is formed in at least one sidewall of the casing for directing fluid back toward the impeller. Improved operating characteristics and extended range are accomplished through modification to the vane configuration of the impeller and/or by modification of the side channel configuration of the pump chamber in an asymmetrical fashion. The vanes can be modified to include a radially inward base portion extending in a generally trailing direction with respect to rotation of the impeller and a radially outward tip portion extending in a generally leading direction. The blades may also include a chamfered surface on the trailing edge of the base portion. The impeller chamber can be modified separately by expanding a side channel in the casing, or by insertion of a spacer between the side channel and the remaining portion of the casing defining the impeller chamber.

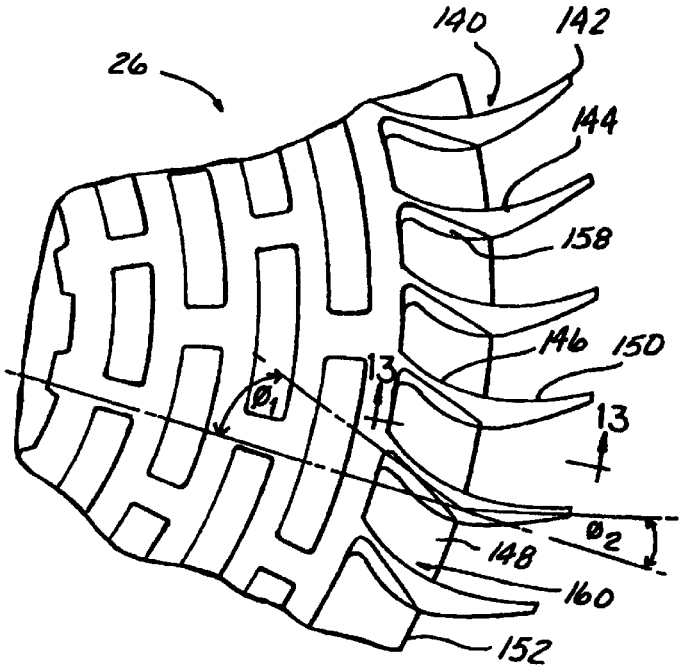

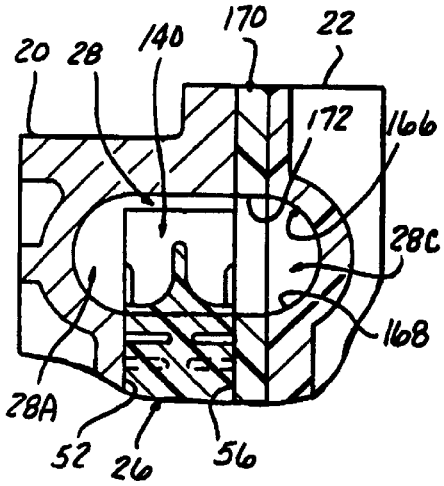

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-36 is confirmed.

* * * * *